US010451255B1

(12) United States Patent
Dai

(10) Patent No.: US 10,451,255 B1
(45) Date of Patent: Oct. 22, 2019

(54) OUTDOOR GARDEN LAMP

(71) Applicant: Ningbo Weitao Electrical Appliance Co., Ltd., Ningbo, Zhejiang (CN)

(72) Inventor: Jiangang Dai, Zhejiang (CN)

(73) Assignee: Ningbo Weitao Electrical Appliance Co., Ltd., Ningbo (CN)

( * ) Notice: Subject to any disclaimer, the term of this patent is extended or adjusted under 35 U.S.C. 154(b) by 0 days.

(21) Appl. No.: 16/161,100

(22) Filed: Oct. 16, 2018

(51) Int. Cl.

| | |
|---|---|
| ***F21V 21/30*** | (2006.01) |
| ***F21V 21/15*** | (2006.01) |
| ***F21V 23/04*** | (2006.01) |
| *F21W 131/109* | (2006.01) |

(52) U.S. Cl.
CPC ..... *F21V 21/15* (2013.01); *F21V 21/30* (2013.01); *F21V 23/0471* (2013.01); *F21W 2131/109* (2013.01)

(58) Field of Classification Search
CPC ..... F21V 21/0824; F21V 21/28; F21V 21/15; F21V 21/26; F21V 21/30; F21V 23/0471; F21V 19/02; F21V 23/06; F21V 17/02; F21V 23/003; F21W 2131/109; F21W 2131/406; H05B 37/032
See application file for complete search history.

(56) References Cited

U.S. PATENT DOCUMENTS

| | | | | |
|---|---|---|---|---|
| 7,393,124 | B1 * | 7/2008 | Williams | F21V 21/36 362/403 |
| 8,232,909 | B2 * | 7/2012 | Kroeger | F21V 23/0442 340/500 |
| 9,316,365 | B1 * | 4/2016 | Ko | F21L 4/02 |
| 2006/0193151 | A1 * | 8/2006 | Quan | F21S 8/033 362/640 |
| 2009/0071516 | A1 * | 3/2009 | Li | F21V 21/34 135/16 |
| 2009/0135411 | A1 * | 5/2009 | Gordin | 356/138 |
| 2016/0298831 | A1 * | 10/2016 | Fang | F21V 21/06 |
| 2016/0313636 | A1 * | 10/2016 | Chien | G03B 29/00 |
| 2017/0003008 | A1 * | 1/2017 | Ito | F21V 21/30 |
| 2018/0058673 | A1 * | 3/2018 | Fang | F21V 27/02 |
| 2018/0067384 | A1 * | 3/2018 | Chien | F21V 29/00 |

* cited by examiner

*Primary Examiner* — Anh T Mai
*Assistant Examiner* — Fatima N Farokhrooz

(57) ABSTRACT

An outdoor garden lamp includes a left mounting base and a right mounting base movably connected by a vertically disposed rotating shaft, and control circuits respectively provided in the left mounting base and the right mounting base. Each of the left mounting base and the right mounting base is connected to a lamp body through a movable shaft; each movable shaft is movably connected with the left mounting base or the right mounting base; each movable shaft is rotatable about an axis thereof; each lamp body is movably connected to the movable shaft corresponding thereto; a bottom of the rotating shaft is connected with a human body sensor through a movably connected transverse rotating body and a movably connected vertical rotating body; and the human body sensor is connected to the control circuits.

5 Claims, 2 Drawing Sheets

OUTDOOR GARDEN LAMP

FIELD OF TECHNOLOGY

The present application relates to the field of lighting technology, in particular to a solar garden lamp used in the outdoor.

BACKGROUND TECHNOLOGY

With the development of the social economy, the development of cities is getting faster and faster. For the convenience of people's lives, lighting equipments are provided in urban communities and parks. Garden lamps are the main lighting equipment and are widely used in communities and various crowded park avenues. Garden lamps light for people at night and are deeply loved by people. However, structural functions of the current garden lamps are relatively simple, which is only to provide lighting functions, so they cannot meet the development needs of urbanization.

First of all, garden lamps are mostly powered by connecting to external power sources. If they are in use for a long time, they need to consume a large amount of electric energy, which is costly and imposes a large burden on the user. At the same time, the garden lamps are turned on by time control. Sometimes there is no pedestrian passing by, and the garden lamps are always turned on, which causes waste of energy.

Secondly, to ensure the aesthetics of the overall effect, garden lamps are usually installed in public places in the same style and at fixed points. But in reality, installation environment of each garden lamp and the environment required lighting are different.

Therefore, in view of the above problems, how to design a novel outdoor garden lamp that has comprehensive functions, good applicability, can adapt to different installation environments, and meet different lighting requirements, has become a direction of thinking for designers of the present application.

SUMMARY

The technical problem to be solved by the present application is to provide a novel outdoor garden lamp that has comprehensive functions, good applicability, can adapt to different installation environments, and meet different lighting requirements.

The technical solution adopted by the present application to solve the above technical problems is: a novel outdoor garden lamp including a left mounting base and a right mounting base movably connected by a vertically disposed rotating shaft, and control circuits respectively provided in the left mounting base and the right mounting base; each of the left mounting base and the right mounting base is connected to a lamp body through a movable shaft; each movable shaft is movably connected with the left mounting base or the right mounting base; each movable shaft is rotatable about an axis thereof; each lamp body is movably connected to the movable shaft corresponding thereto; a bottom of the rotating shaft is connected with a human body sensor through a movably connected transverse rotating body and a movably connected vertical rotating body; and the human body sensor is connected to the control circuits.

A further preferred solution of the present application: the left mounting base and the right mounting base are symmetrically disposed; the left mounting base and the right mounting base form a disc-shaped structure; a front side of the right mounting base is provided with an outward protrusion; and the movable shaft corresponding to the right mounting base is movably mounted on a side of the protrusion.

A further preferred solution of the present application: the left mounting base and the right mounting base are movably sleeved outside the rotating shaft, and rear sides of the left mounting base and the right mounting base are provided with mounting holes for fixed installation.

A further preferred solution of the present application: the bottom of the rotating shaft is movably connected to the transverse rotating body; the transverse rotating body is vertically disposed to be horizontally rotatable about the rotating shaft; one end of the vertical rotating body is movably connected with the transverse rotating body and another end of the vertical rotating body is connected with the human body sensor; and the vertical rotating body is rotatable in a vertical direction about an axis thereof.

A further preferred solution of the present application: the human body sensor is provided with a time adjustment knob, a distance adjustment knob and a sensitivity adjustment knob.

A further preferred solution of the present application: each lamp body is movably disposed above the movable shaft corresponding thereto, and each lamp body is horizontally rotatable about an axis thereof.

Compared with the prior art, the advantages of the present application lie on that the left mounting base and the right mounting base are movably connected by a vertically disposed rotating shaft. That is to say, the present application has designed two components for fixed installation, and the two can be relatively rotated, their included angle is flexible and adjustable, and can adapt to installation environments such as a folded surface or even a curved surface. A control circuit is provided in the left mounting base and the right mounting base, respectively. The bottom of the rotating shaft is connected with a human body sensor through the movably connected transverse body and the movably connected vertical rotating body and the human body sensor is connected to the control circuits. The garden lamp of the present application can sense, using the human body sensor, whether there is a pedestrian passing, thereby controlling the lighting of the lamp bodies, being more humanized and avoiding waste of power resources. The left mounting base and the right mounting base are respectively connected to the lamp bodies through the movable shafts. Each of the movable shafts is movably connected with the left mounting base or the right mounting base. The movable shafts are rotatable about the axis. The lamp bodies are movably connected to the movable shafts. The structure setting of the movable shafts enables the lamp bodies to rotate in the vertical direction. The lamp bodies themselves are movably connected with the movable shafts, enabling horizontal rotation. The two lamp bodies do not affect each other which can meet different lighting needs.

BRIEF DESCRIPTIONS OF THE DRAWINGS

DETAILED DESCRIPTIONS

The present application will be described in detail below with reference to the accompanying drawings.

In order to make the objectives, technical solutions, and advantages of the present application clearer and more comprehensible, the present application will be further described in detail below with reference to the accompanying drawings and embodiments. It should be understood that the specific embodiments described herein are only used to explain the present application and are not used to limit the present application.

Figure 1:
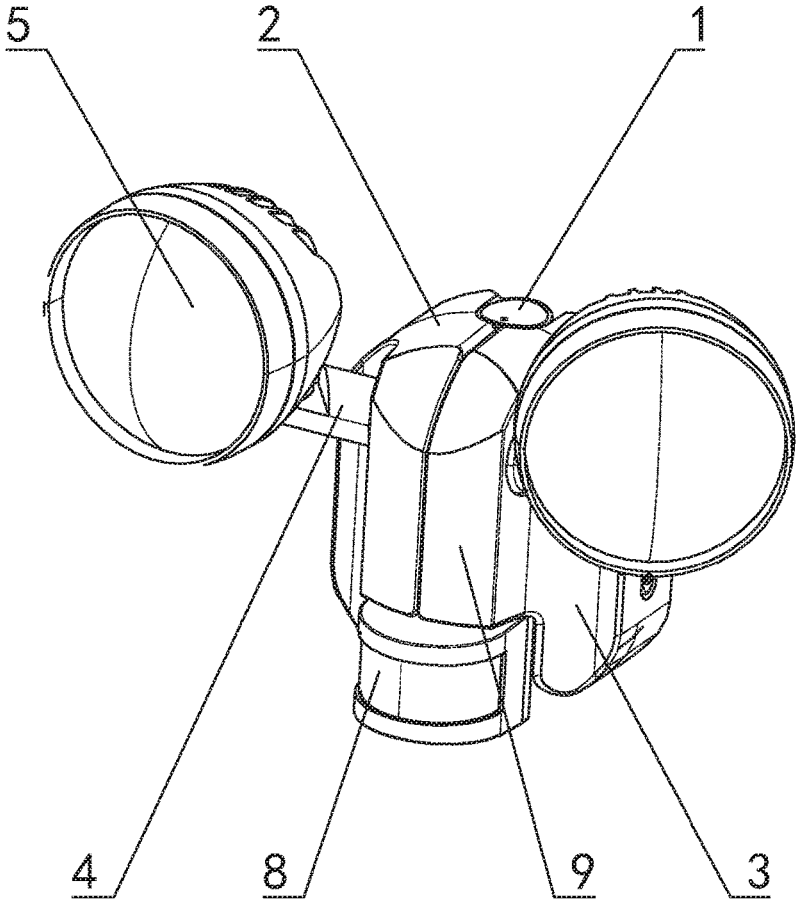
FIG. 1 is a first schematic structural view of the present application.
Figure 2:
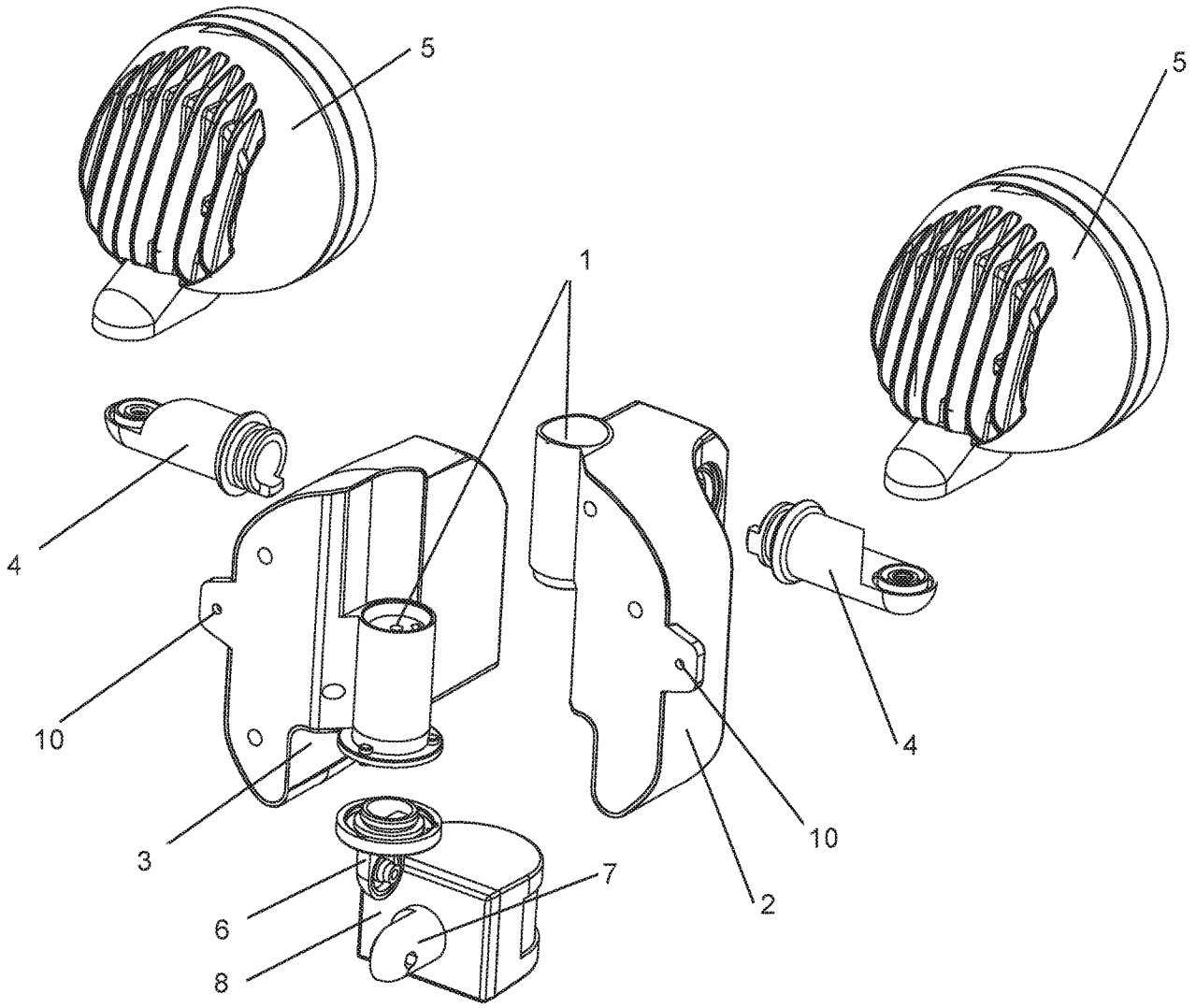
FIG. 2 is a second schematic structural view of the present application.

As shown in FIGS. 1 to 2, a novel outdoor garden lamp includes a left mounting base 2 and a right mounting base 3 movably connected by a vertically disposed rotating shaft 1, and control circuits respectively provided in the left mounting base 2 and the right mounting base 3; each of the left mounting base 2 and the right mounting base 3 is connected to a lamp body 5 through a movable shaft 4; each movable shaft 4 is movably connected with the left mounting base 2 or the right mounting base 3; each movable shaft 4 is rotatable about an axis thereof; each lamp body 5 is movably connected to the movable shaft 4 corresponding thereto; a bottom of the rotating shaft 1 is connected with a human body sensor 8 through a movably connected transverse rotating body 6 and a movably connected vertical rotating body 7; and the human body sensor 8 is connected to the control circuits.

The left mounting base 2 and the right mounting base 3 are symmetrically disposed; the left mounting base 2 and the right mounting base 3 form a disc-shaped structure; a front side of the right mounting base 3 is provided with an outward protrusion 9; and the movable shaft 4 corresponding to the right mounting base is movably mounted on a side of the protrusion 9. If the present application is directly installed on a plane, then the structure setting of the left mounting base 2 and the right mounting base 3 appear to be a unitary structure, which is more beautiful and elegant.

The left mounting base 2 and the right mounting base 3 are movably sleeved outside the rotating shaft 1, and rear sides of the left mounting base 2 and the right mounting base 3 are provided with mounting holes 10 for fixed installation. The left mounting base 2 and the right mounting base 3 are each provided with a mounting hole 10 so that the two can be separately fixed on two planes without affecting each other. The structure setting of the present application can be fixedly installed while meeting different installation environments and having good adaptability.

The bottom of the rotating shaft 1 is movably connected to the transverse rotating body 6; the transverse rotating body 6 is vertically disposed to be horizontally rotatable about the rotating shaft 1; one end of the vertical rotating body 7 is movably connected with the transverse rotating body 6 and another end of the vertical rotating body 7 is connected with the human body sensor 8; and the vertical rotating body 7 is rotatable in a vertical direction about an axis thereof. In view of the flexibility of the installation environment of the present application, the position setting of the human body sensor 8 also requires comparable flexibility. Therefore, the transverse rotating body 6 and the vertical rotating body 7 are provided, so that the human body sensor 8 can be adjusted in both horizontal and vertical directions to meet environmental requirements.

The human body sensor 8 is provided with a time adjustment knob, a distance adjustment knob and a sensitivity adjustment knob. The time adjustment knob can adjust the time to light up the lamp bodies 5 after sensing. The distance adjustment knob adjusts the sensing distance of the human body sensor 8. The sensitivity adjustment knob adjusts the sensing sensitivity of the human body sensor 8.

Each lamp body 5 is movably disposed above the movable shaft 4 corresponding thereto, and each lamp body 5 is horizontally rotatable about an axis thereof. The setting of the lamp bodies 5 of the present application also has a very flexible adjustment range. Rotation in the vertical direction can be achieved via the movable shaft 4.

The present application is also designed with a connector for connecting with a solar panel. The present application can externally connect with the solar panel and can be powered by the solar panel.

The foregoing descriptions are merely preferred embodiments of the present application and are not intended to limit the present application. Any modification, equivalent replacement and improvement made within the spirit and principle of the present application shall be included in the scope of protection of the present application.

What is claimed is:

1. An outdoor garden lamp, comprising a left mounting base and a right mounting base movably connected by a vertically disposed rotating shaft, and control circuits respectively provided in the left mounting base and the right mounting base; wherein each of the left mounting base and the right mounting base is connected to a lamp body through a movable shaft; each movable shaft is movably connected with the left mounting base or the right mounting base; each movable shaft is rotatable about an axis thereof; each lamp body is movably connected to the movable shaft corresponding thereto; a bottom of the rotating shaft is connected with a human body sensor through a movably connected transverse rotating body and a movably connected vertical rotating body; and the human body sensor is connected to the control circuits wherein the left mounting base and the right mounting base are symmetrically disposed; the left mounting base and the right mounting base form a disc-shaped structure; a front side of the right mounting base is provided with an outward protrusion that wraps around the vertically disposed rotating shaft; and the movable shaft corresponding to the right mounting base and the left mounting base is movably mounted on a side of the protrusion.

2. The outdoor garden lamp of claim 1, wherein the left mounting base and the right mounting base are movably sleeved outside the rotating shaft, and rear sides of the left mounting base and the right mounting base are provided with mounting holes for fixed installation.

3. The outdoor garden lamp of claim 1, wherein the bottom of the rotating shaft is movably connected to the transverse rotating body; the transverse rotating body is vertically disposed to be horizontally rotatable about the rotating shaft; one end of the vertical rotating body is movably connected with the transverse rotating body and another end of the vertical rotating body is connected with the human body sensor; and the vertical rotating body is rotatable in a vertical direction about an axis thereof.

4. The outdoor garden lamp of claim 1, wherein the human body sensor is provided with a time adjustment knob, a distance adjustment knob and a sensitivity adjustment knob.

5. The outdoor garden lamp of claim 1, wherein each lamp body is movably disposed above the movable shaft corresponding thereto, and each lamp body is horizontally rotatable about an axis thereof.

* * * * *